US010716365B2

(12) United States Patent
De Souza

(10) Patent No.: US 10,716,365 B2
(45) Date of Patent: Jul. 21, 2020

(54) SHOE UPPER MOUNTING MACHINE WITH STRING LASTING MEANS

(71) Applicant: I.S.A. Indústria De Tecnologia E Automacão Ltda—EPP, Nova Hamburgo (BR)

(72) Inventor: Silvano Baptista De Souza, Novo Hamburgo (BR)

(73) Assignee: I.S.A. Indústria De Tecnologia E Automacão Ltda—EPP, Canudos (BR)

( * ) Notice: Subject to any disclaimer, the term of this patent is extended or adjusted under 35 U.S.C. 154(b) by 76 days.

(21) Appl. No.: 15/579,674

(22) PCT Filed: Aug. 10, 2015

(86) PCT No.: PCT/BR2015/050115
§ 371 (c)(1),
(2) Date: Dec. 5, 2017

(87) PCT Pub. No.: WO2016/197213
PCT Pub. Date: Dec. 15, 2016

(65) Prior Publication Data

US 2018/0140055 A1 May 24, 2018

(30) Foreign Application Priority Data

Jun. 9, 2015 (BR) ..... 1020150133570

(51) Int. Cl.
*A43D 15/00* (2006.01)
*A43D 3/02* (2006.01)
(Continued)

(52) U.S. Cl.
CPC ..... *A43D 15/00* (2013.01); *A43D 3/022* (2013.01); *A43D 9/00* (2013.01); *A43D 21/003* (2013.01); *A43D 21/08* (2013.01); *A43D 3/12* (2013.01)

(58) Field of Classification Search
CPC ..... A43D 15/00; A43D 3/12; A43D 3/022; A43D 9/00; A43D 21/003; A43D 21/08
See application file for complete search history.

(56) References Cited

U.S. PATENT DOCUMENTS 1,833,229 A * 11/1931 Sahr ..... A43D 9/00 12/7.3
2,010,090 A * 8/1935 La Chapelle ..... A43D 9/00 12/145

(Continued)

FOREIGN PATENT DOCUMENTS

BR 20130228591 A2 8/2015
EP 162696 A2 11/1985

(Continued)

*Primary Examiner* — Jila M Mohandesi
(74) *Attorney, Agent, or Firm* — McKee, Voorhees & Sease, PLC

(57) ABSTRACT

A shoe upper mounting machine with a string lasting means is designed for mounting a shoe upper using a string lasting means for the footwear mounting sector with high-productivity, using the string lasting method of sewing the edges with a lasting string. The invention includes the use of this technology in footwear models which are normally excluded because they have sturdy, not flexible shoe uppers which are difficult to conform using string lasting. It is sufficient to provide a shoe upper with new dimensions suitable for this mounting technology. The machine is capable of lasting any string and adjusting any shoe upper to the form, provided these materials conform with acceptable quality standards for footwear components. The invention is characterized by a module (3) for fitting shoe uppers onto the form (F), a string lasting module (4), and optionally a module (5) for coupling and uncoupling the couplable footwear form.

20 Claims, 9 Drawing Sheets

(51) Int. Cl.

| | |
|---|---|
| ***A43D 21/08*** | (2006.01) |
| ***A43D 9/00*** | (2006.01) |
| ***A43D 21/00*** | (2006.01) |
| *A43D 3/12* | (2006.01) |

(56) References Cited

U.S. PATENT DOCUMENTS

| | | | | | |
|---|---|---|---|---|---|
| 2,025,998 | A | * | 12/1935 | Miller | A43D 21/125<br>12/7.3 |
| 3,474,475 | A | | 10/1969 | Fisk | |
| 3,570,151 | A | * | 3/1971 | Eaton | A43B 9/00<br>36/46.5 |
| 3,778,856 | A | | 12/1973 | Christie et al. | |
| 3,902,211 | A | | 9/1975 | Lindsey | |
| 3,972,086 | A | | 8/1976 | Belli et al. | |
| 4,118,815 | A | | 10/1978 | Crimella | |
| 4,592,798 | A | * | 6/1986 | Simmonds, Jr. | A43D 11/00<br>101/114 |
| 8,595,878 | B2 | * | 12/2013 | Huffa | A43B 9/00<br>12/145 |

FOREIGN PATENT DOCUMENTS

| | | | |
|---|---|---|---|
| GB | 169122 | A | 9/1921 |
| GB | 1413502 | A | 11/1975 |

* cited by examiner

SHOE UPPER MOUNTING MACHINE WITH STRING LASTING MEANS

CROSS REFERENCE TO RELATED APPLICATIONS

This is a U.S. National Phase application claiming priority to PCT/BR2015/050115, filed Aug. 10, 2015, which claims priority to Brazilian application BR10201501335, filed Jun. 9, 2015, the entire contents of which are hereby expressly incorporated by reference in their entirety, including, without limitation, the specification, claims, and abstract, as well as any figures, tables or drawings thereof.

FIELD OF THE INVENTION

This application for a Patent of Invention addresses a shoe upper mounting machine with a string-lasting device designed for mounting a shoe upper using a string-lasting device, for the high-productivity footwear assembly sector, using the string-lasting method-stitching the edges with a lasting string. The invention also includes the use of this technology in footwear models that are normally excluded as they have tough and not very flexible shoe uppers that are difficult to shape through string-lasting. For that purpose, it is sufficient to provide a shoe upper with new dimensions suitable for this assembly technology, whenever necessary. The machine is able to tighten any string and adjust any shoe upper to the last, provided that these materials comply with acceptable quality standards for footwear components.

The machine may thus be used to assemble the following footwear models: children's, women's, men's, safety, sports, capital or formal, such as trainers, flats, sneakers, shoes, high-heeled pumps, boots (fashion and military), etc;

In terms of use, placement of the machine addressed by the invention in industry encompasses different layouts defined by the different needs of each footwear model to be fabricated. As a result, the machine may be arrayed alongside assembly belts or in technology cells close to sole injection units that inject polymers directly on to the assembled shoe uppers, at independent positions and others.

STATE OF THE ART

In low-yield processes, shoe uppers may be assembled on the last and taped into place by hand using a type of metal nail produced especially for this purpose, or with synthetic adhesives. They may also be assembled with the help of heel and toe machines that respectively assemble the front and back of the footwear separately, using thermoplastic adhesives.

In large-scale production processes, shoe uppers may be assembled essentially through the string-lasting method which consists of overstitching along the edges of shoe uppers over a lasting string. When tightened, this string compresses the entire edge of the stitched leather, wrinkling it. The outcome is that the leather is shaped against the lower part of the last, leaving it ready to receive the sole. An inner sole might or might not be stitched to the shoe uppers in a partial manner known as semi-bagged plus string. The sole may be attached to the leather by adhesive or direct injection of soles.

For high-productivity processes, leather may also be assembled through full bagging, where it is pre-shaped, meaning that it is given the shape of a foot by specific machines, and is then fully stitched to an inner sole by the lock stitching machine and is then bagged on the last.

Traditionally, the task of assembling shoe uppers on the mold and string-lasting in string-lasting assembly methods are performed manually by one or two workers respectively, one for each stage, using only simple tools to facilitate these tasks.

For these tasks, workers usually have a workbench with a rod for attaching the last, in addition to a hand-held shoe horn and possibly protective gauntlets. This bench is not fitted with devices for making fine positioning adjustments, whereby the placement of the leather on the last and the string-lasting process depend solely on the strength and skill of the operator in question.

There are ancillary items of mechanical equipment that are intended to tighten the string, although their function is limited to this tightening at a pre-set fixed force.

One of the known items of equipment with a specific string-tightening function for footwear assembly through the string-lasting process is fabricated by the SAZI company in Farroupilha, Rio Grande do Sul State.

The equipment mentioned in the previous paragraph is more commonly used with sole injectors, for direct injection.

The equipment mentioned above consists of a motorized system that coils the ends of the string on a rotating axis. With longitudinal grooves for slotting the string, this axis is operated by a pedal that operates a geared engine. Reversing this rotation to release the spring occurred when the first pedal is released, and the second pedal is activated.

In this case, there is no proportional control of tightening speed and strength that translates the command given by the operator and encompasses the need for minor variations in the course of each tightening operation. This device merely tightens the string and has no module for joint implementation of the task of assembling the leather on the last, nor does it have an automatic shoe horn with automatic proportional force control.

Another known and marketed system is a string-lasting device developed from the conceptual stage onwards by ISA in 2012/11, whose initial design provided input information on its functioning and feasibility for use in large-scale production processes, with this technology now improved and claimed through this patent application.

Current lasting-string footwear assembly systems, which include those described above, are fairly well known, in addition to being the cheapest available options. However, they are not widely used, compared to the advantages of adopting these processes, resolving problems that arise in practice.

These difficulties are initially due to the fact that string-lasting is usually dependent on a specialized operator, subject to constraints related to skills and physical conditions appropriate for human beings.

Even if such operator, selected for his physical fitness, were to work efficiently, after long periods of time demanding repetitive physical effort it is common to develop repetitive strain injuries (RSI).

In turn, these injuries lead to a set of costs for companies investing in selection processes and training sessions, with expenditures incurred through time off work and rehabilitation. The worker himself is subject to irreversible physical consequences that disqualify him from jobs, as he is unlikely to return to performing the same function as a skilled worker. Moreover, there are significant outlays imposed on public health and social security systems.

On the other hand, the limitations of the mechanized ancillary equipment that is currently available also do not encourage string-lasting assembly, as problems such as string breakage, total task speed, agility in performing functions, practicality, lack of accuracy, replicability and impossibility of making fine adjustments to positions, together with the need for the footwear to be assembled on the last by another skilled worker at another supplementary work position are factors that make it impossible, stepping up costs and under mining assembly production capacity using this equipment.

All these constraints limit string-lasting assembly operations to a few companies that use the process only to assemble a few footwear models whose materials are endowed with appropriate flexibility and resistance.

These companies generally prefer to assemble most of their model through traditional methods, such as assembly by specific machines for shaping, for example, as well as toe-cap, heel-cap, vamp and assembly machines. However, this equipment is expensive, with limited production capacity and high operating costs.

In an attempt to upgrade production systems, the state of the art is seeking to build machines that would recognize some operations. For example, this occurs with document GB1253448 dated Nov. 10, 1971 on improvements in or related to a shoe upper shaping machine, which describes a machine that includes support for the foot last, a pair of articulated arms, with means for gripping a cord on their upper extremities, as well as a pair of cylinders that move the above-mentioned arms, thus tightening the string. Constituting the state of the art, this document discloses a leather support with arms for applying the string to the above-mentioned shoe uppers; however, this is a complex technology and does not disclose a module for attaching the shoe uppers in a mechanical manner and another for applying the string thereto. The complexity of this equipment does not allow the procession to be obtained which is one of the objectives of this invention, nor the desired operational speed. Moreover, it has a high added cost with the possibility of frequent maintenance that would halt production systems. Furthermore, it does not encompass a string-lasting device module and an uppers bagging module, with these earlier documents mentioning two ends of the string attached on opposite sides of a mechanism, each of which is operated by a piston, and also not including a clip or clamp for adjustment to the shoe uppers.

Another document known at the state of the art is MU8300314-2 dated Feb. 28, 2003, that addresses a FOOTWEAR CONSTRUCTION SYSTEM, which describes the elimination of the midsole in the front half of the shoe, which is replaced by a lining attached through string-stitching to the shoe uppers, sides and lower front thereof, with a heel-cushion held in place with tacks and glues, instead of the midsole, with the used sole having an impact absorber and inner soles.

ADVANTAGES OF THE INVENTION

This patent invention is supported by technical solutions that have been properly designed for performing the work, using either operators with normal physical characteristics, and even by women, and thus not requiring attributes that were previously required in the qualifications of these workers. Furthermore, the tightening system with proportional force control replaces manual tightening and avoids repetitive stress injuries.

The solutions contained in the proposed equipment converge, whereby both operations—fitting the shoe uppers on the last and string-lasting—may be performed manually by a single operator, but with greater speed and accuracy. This results in better quality, greater replicability and higher productivity, in addition to releasing the operator from harmful physical efforts.

Another quite innovative advantage introduced by proportional force control and speed is the scope of the string-lasting method, which may be extended to the assembly of footwear with uppers made from tougher or less flexible materials. Moreover, gains in terms of economics, operating safety, higher per capita production capacity and lower electricity consumption are reflected in lower operating costs, providing incentives for the string-lasting assembly method to be widely used in the footwear industry, including the production of footwear models where this was not previously an option, such as high heeled pumps, boots (fashion and military), safety shoes and others.

The modifications resulting from the adaptation of footwear models to assembly by the machine in question result in lower raw material consumption, mainly shoe uppers, with a resulting reduction in scrapped leather.

The tightening system was conceptualized on the basis of a design that encompasses ergonomics and the array of sophisticated components, able to service companies using simple conventional technologies, or even companies using automated robotics systems.

GENERAL DESCRIPTION OF THE INVENTION

The shoe uppers assembly machine with a string-lasting device addressed by this invention is intended for the high-productivity footwear assembly sectors through the string-lasting method-stitching the edges with a lasting string.

The machine of this patent sought consists of a metal support housing that holds three modules with different purposes but with associated supplementary sequential actions with these models able to perform their functions individually or together. The module for fitting shoe uppers on to the last with an upper gripper clamp and string-lasting device module with a string gripper clamp are worked by a proportional command pedal with its own technology that functions through the proportional pressure applied by the operator. The third module for assembling and dismantling mountable lasts does not need a proportional command to perform its functions.

The production advantages offered by this equipment consist mainly of higher productivity, better replicability and standardization, resulting in improved product quality, eliminating repetitive stress injuries, with total function controlled by the operator, associated task performance by a single operator, shorter downtimes, fine tuning services and extending the scope of the string-lasting assembly method to the fabrication of other footwear that was previously not suitable for this process.

BRIEF DESCRIPTION OF THE DRAWINGS

The invention will be described below in an embodiment of a last, making reference to the appended drawings for better understanding, which present.

DETAILED DESCRIPTION OF THE DRAWINGS

Figure 1:
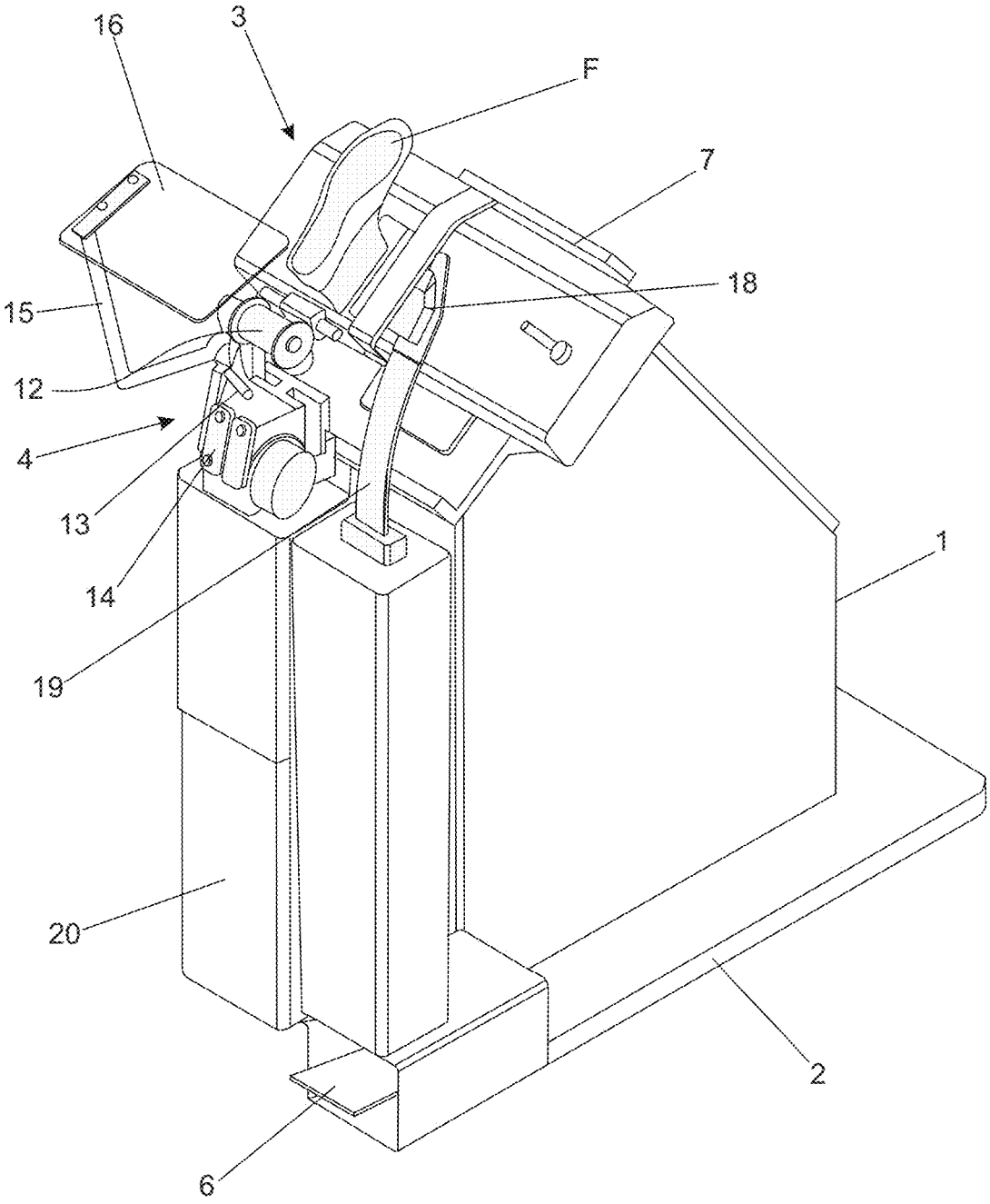
FIG. 1: Perspective overview of the machine according to the invention.

The Shoe upper mounting machine with string-lasting device addressed by this application for a Patent of Invention comprises a metal support housing (1), supported on a flat base (2), with a module (3) for fitting shoe uppers on to the last (F), or a string-lasting device module (4) and optionally a module (5) for assembling and dismantling the mountable shoe last. The use of these modules in the equipment may be through association, meaning module (3) together with module (4), together with module (5), with these modules having different purposes, although with associated and complementary actions.

Figure 11:
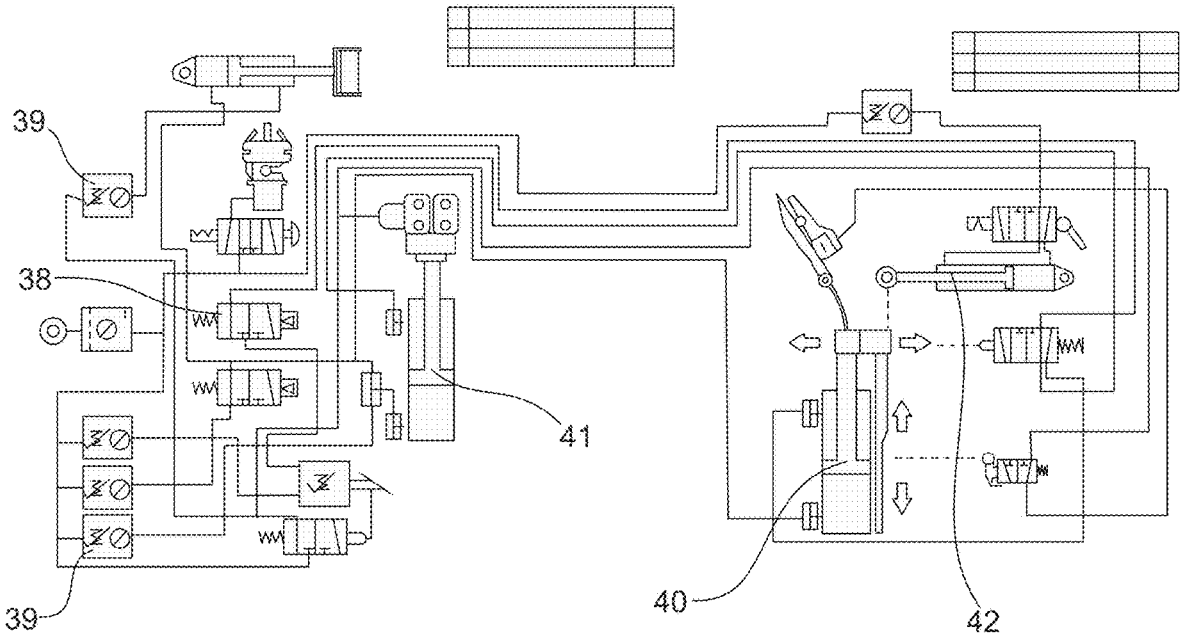
FIG. 11: Schematically shows the string-lasting device module and the uppers bagging module.
Figure 12:
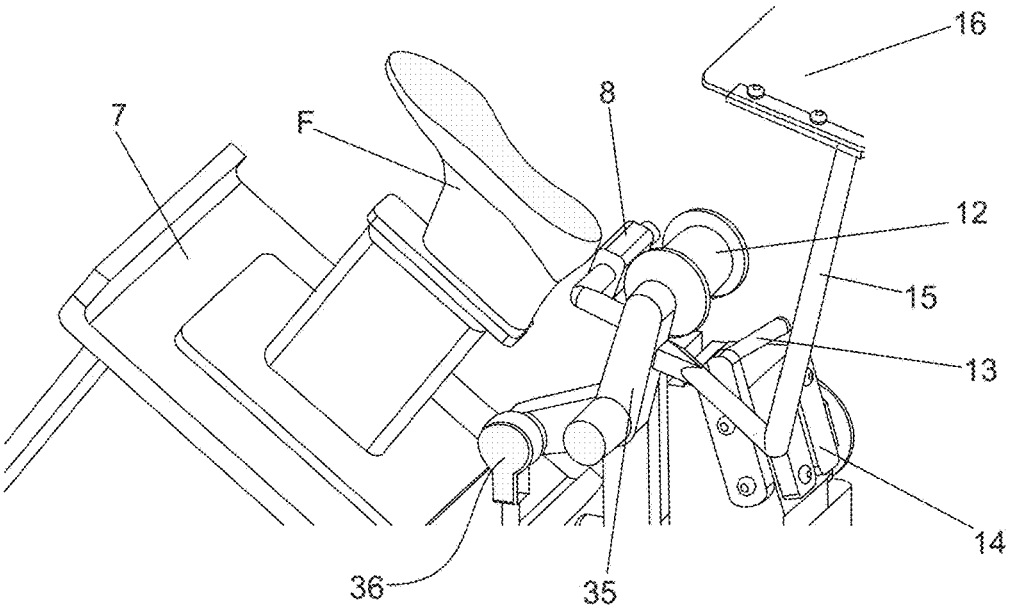
FIG. 12: Shows a partial perspective view of the machine according to the invention with the buffer-stop for holding the heel and the anchor-brace holding the last.
Figure 13:
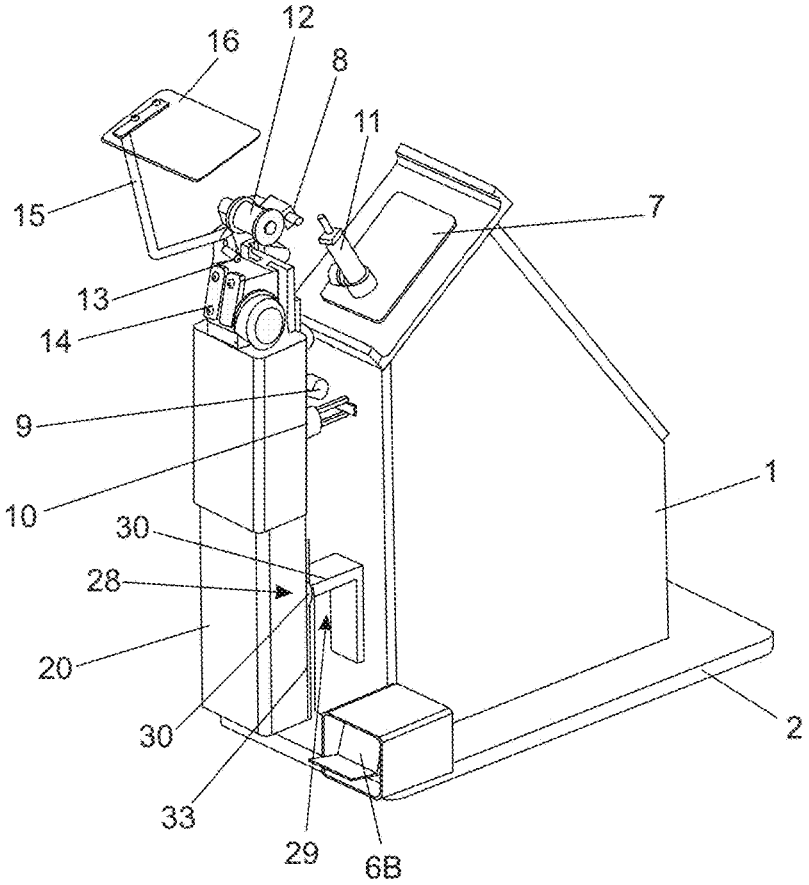
FIG. 13: Shows a perspective view of the machine according to the invention, with a device for boots with height regulation.
Figure 14:
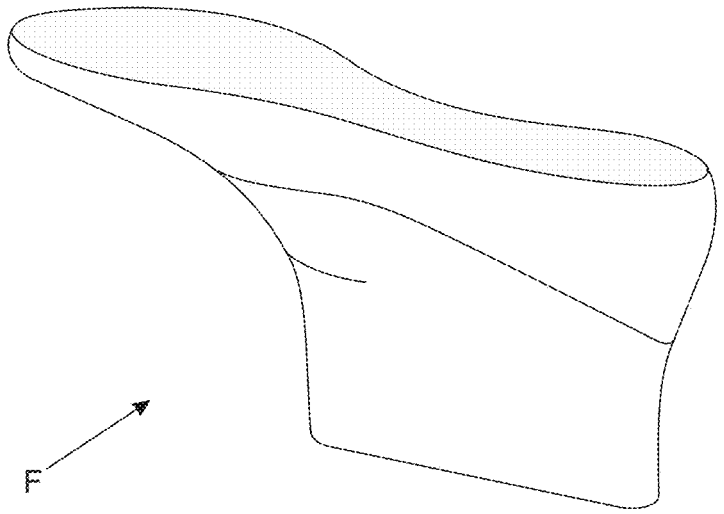
FIG. 14: Shows the last in perspective with shoe uppers.
Figure 15:
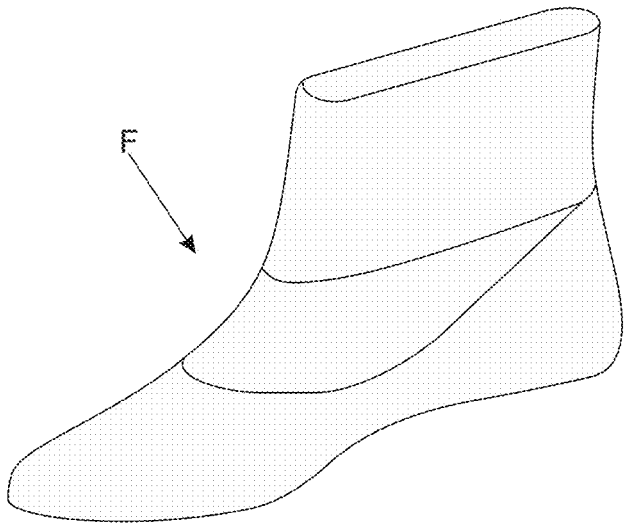
FIG. 15: Shows the last in perspective with shoe uppers, in the opposite position to the previous Figure.

Modules (3) and (4) are worked by a pedal (6) with a double start-up command (on/off) and a proportional force and speed command, which is handled through the command shown in FIG. 11.

The last (F) for holding the shoe uppers (C1) is arrayed on a support (S1) that anchors the last, positioned on an inclined surface (7) on the upper part of the equipment, with a buffer-stop at the front of the last (F) for holding the heel (8) which has vertical height regulation through pivoting (9) on a support (10) and with horizontal proximity through displacement of this support (10), positioning the tractioning device assembly rod closer or further away in order to adapt it to the different footwear sizes to be assembled. Optionally, the machine may be fitted with a device for boots (11) with height adjustment, in addition to having a string guide roller (12) at the front of the last (F), which is aligned with a string brace (13), attached to a support (14), from which the arm (15) of the protective transparent cover (16) projects.

The module (3) for fitting shoe uppers onto the last (F) is comprised of a mechanical pneumatic assembly composed of the brace anchoring the actual last (17), together with a shoe horn and uppers gripper clamp (18), a flexible blade (19) mounted in the structure (20), through which the tractioning device (21) of the shoe horn with an adjustable clamp release sensor and with the said tractioning device (21) adjustable through a slot (22) in the structure.

Figure 5A:
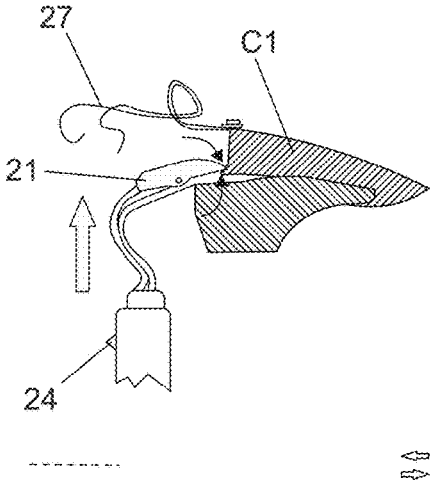
FIG. 5: Sequentially shows the functions of the module for fitting uppers on the last, with (a) the clamp gripping the shoe uppers through the shoe horn tractioning device; (b) with the clamp starting to move away from the shoe uppers; and (c) with the clamp away from the shoe uppers.
Figure 5B:
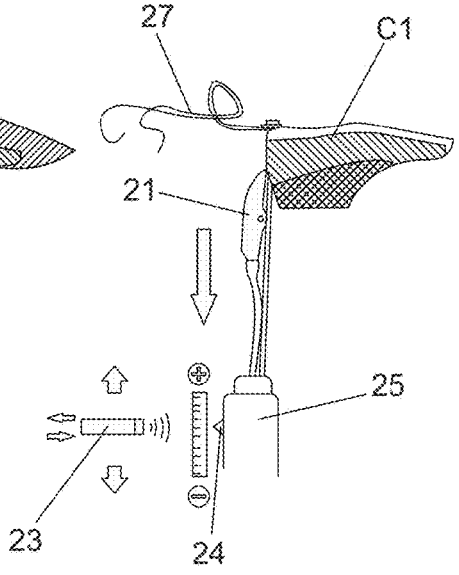
Figure 5C:
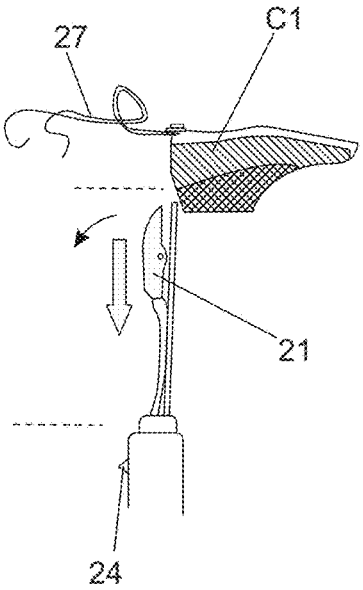

In FIG. 5 the shoe horn tractioning device (21) with an adjustable sensor is shown in detail in (b), where the sensor (23) and the receiver (24) which can be seen attached to the clamp activation assembly, particularly in the middle (25) where the flexible blade is affixed (19).

Figure 6A:
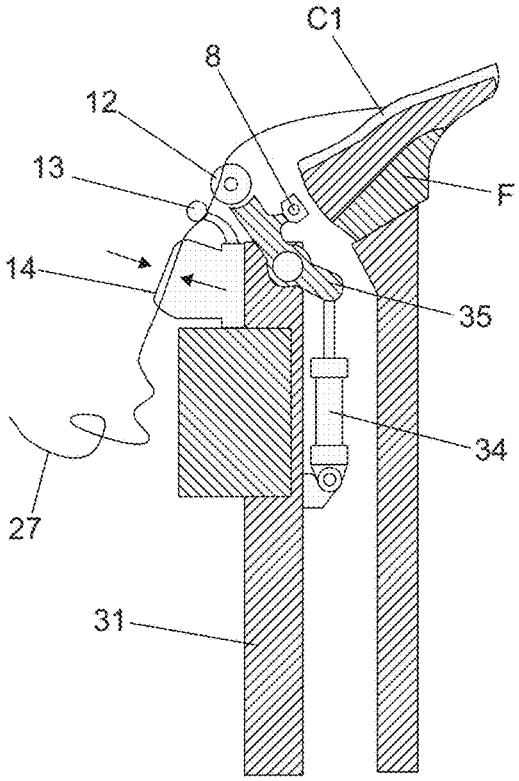
FIG. 6: Illustrates an operating sequence of the clamp and its respective pneumatic operating system, with (a) being the initial stage and (b) the final stage.
Figure 6B:
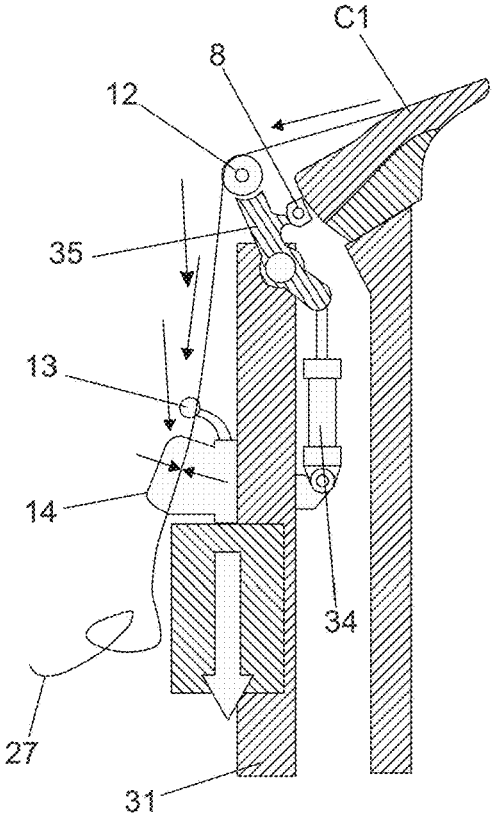
Figure 7:
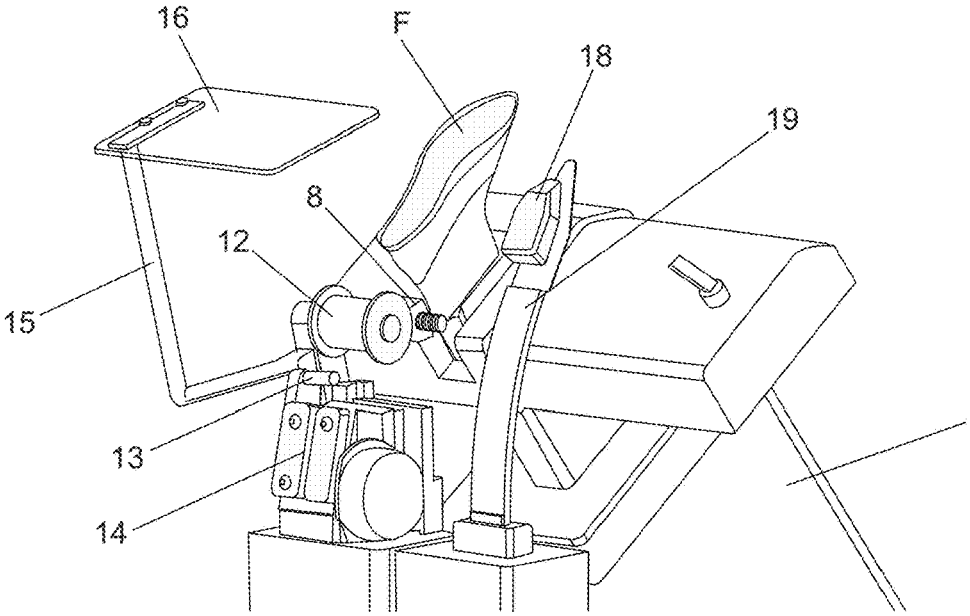
FIG. 7: Shows a partial perspective view of the machine according to the invention, highlighting the string guide roller, the string brace and a protective transparent cover.

The string-lasting device module (4) is a mechanical pneumatic assembly composed of the above-mentioned support (S1) that anchors the last (F), with this assembly presented in greater detail in FIG. 6, where the support (S1) functions in association with the support in contact with the shoe uppers (26) and the string guide roller (12); it also encompasses a string gripper clamp (27), in addition to the above-mentioned buffer-stop (8) for holding the heel, with vertical height and horizontal proximity regulation, as well as the vertical height (28) and horizontal proximity (29) adjustment system of the complete tractioning device assembly, with vertical regulation handled through a sliding handle or knob (30) on a vertical bar (31), and horizontal adjustment through a toothed bar (32) that can slide along a slot (33); it also encompasses the said string guide roller (12), the string brace (13) and the described transparent protection (16); it also encompasses the tightening module (4) and the proportional action pedal (6).

FIG. 6 discloses further details of the tractioning device assembly, showing a string-lasting force activator (C2), through a pneumatic cylinder (34) activated by the pedal (6), which operates through an articulated arm (35) alongside the string guide roller (12), also operating through a contact support point (36) with the shoe uppers (12B). With this construction having a linear movement of the string-lasting force activator.

Figure 10:
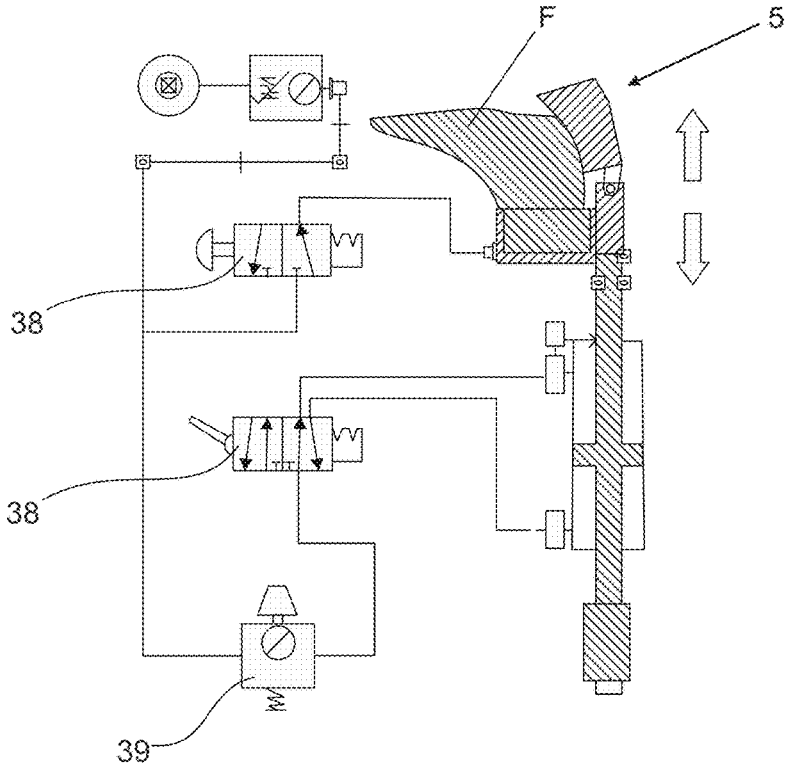
FIG. 10: Shows a model made by ISA for the assembly and dismantling of the mountable shoe last.

As mentioned above, the invention may also optionally encompass a module (5) made by the applicant (I.S.A.) for assembling and dismantling the mountable shoe last, best shown in FIG. 10; the said module (5) is intended to allow shoe uppers (C1) to be fitted more easily on the last (F) or to remove an assembled shoe therefrom. This module (5) does not require a proportional command.

Figure 4:
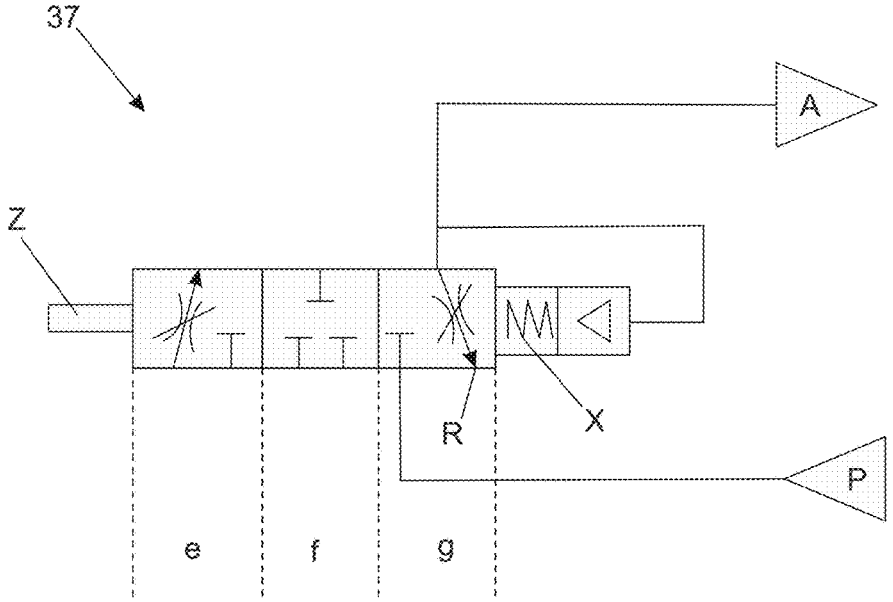
FIG. 4: Schematic drawing of the proportional direct action pressure valve (force) and flow (speed), illustrating its main components.

FIG. 4 shows the direct-action pressure valve (force) and flow (speed) (37), with the logic project design and architecture developed for this machine defining the pneumatic valves and activators as elements generating movements and attachments (FIG. 11).

For the results of the machine to be satisfactory in terms of operating time, for the quality and accuracy of the string-lasting force and speed control under the command of the operator on production lines, the invention encompasses an active sensor pneumatic valve installed on the command pedal (6) that serves as a proportional sensor for operator actions, activating the string-lasting force and speed multiplication activator (C2).

This valve (37), shown in FIG. 4, has a proportional pressure mechanical activation pin (Z), as well as a pressure inflowpoint (P) for the system. The element (A) presents the pneumatic flow outlet with pressure and flow proportional to the activation action of (Z); the element (R) represents the return of the working pressure (A) into the atmosphere, while (X) is action spring for returning to the rest position. The element (e) indicates the proportional action position, while (f) is the proportional control mid-position and (g) is the proportional return mid-position of the action.

FIG. 11 shows the automation of the string-lasting device module (4) and the uppers fitting module (3), with this proportional pedal (6) connected to a sequence of three-way valves (38) on the string-lasting device module (4), with this assembly functioning with pressure regulators (39), while the pneumatic cylinders (40) handle the activation and control of the string gripper clamp assembly (27) (C2). The uppers bagging module (3) discloses an activation pneumatic cylinder (41) alongside the uppers gripper clamp (18), with a set of three-way valves (38) and a second tension pressure return pneumatic cylinder (42).

Figure 8:
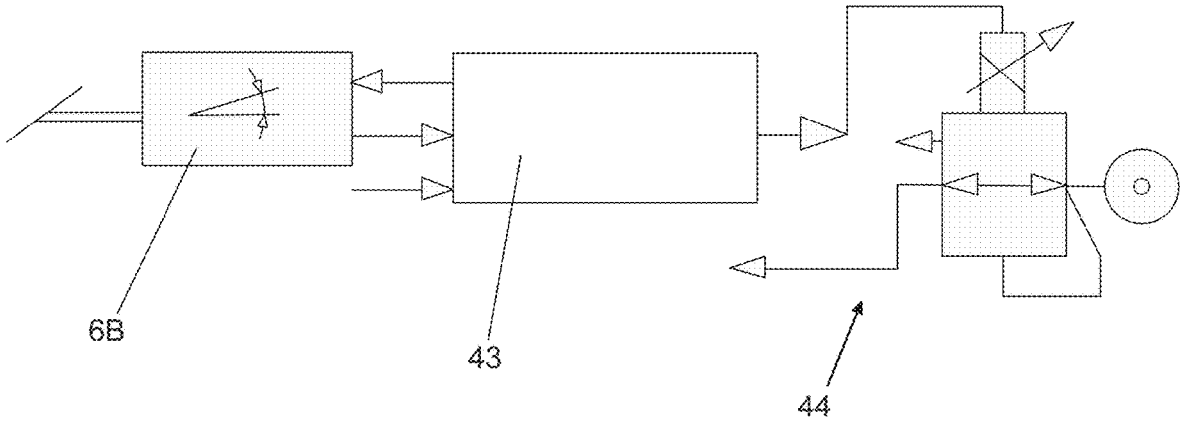
FIG. 8: Shows the electro-pneumatic circuit for the sensor and the proportional force and speed activator.
Figure 9:
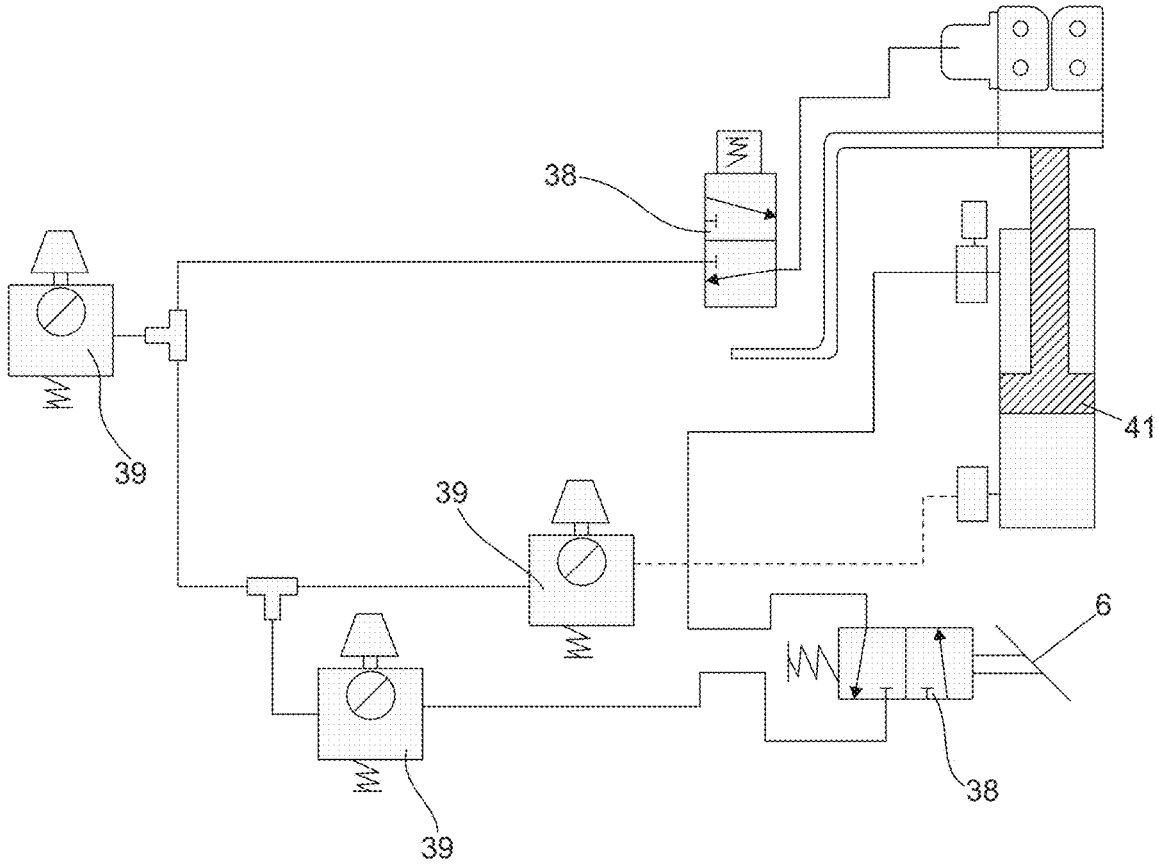
FIG. 9: Schematically shows a string-type tractioning device.

FIG. 8 shows the electro-pneumatic sensor circuit and the proportional force and speed activator, with an electronic pedal (6B), a logic controller (43)—electronic signal processing module—powering the pedal (6B) and that intercommunicate through a proportional pressure transducer (44)—proportional power activation through an electro-pneumatic proportional valve at the pneumatic circuit outlook point (45), presented as an alternative construction solution.

Figure 2:
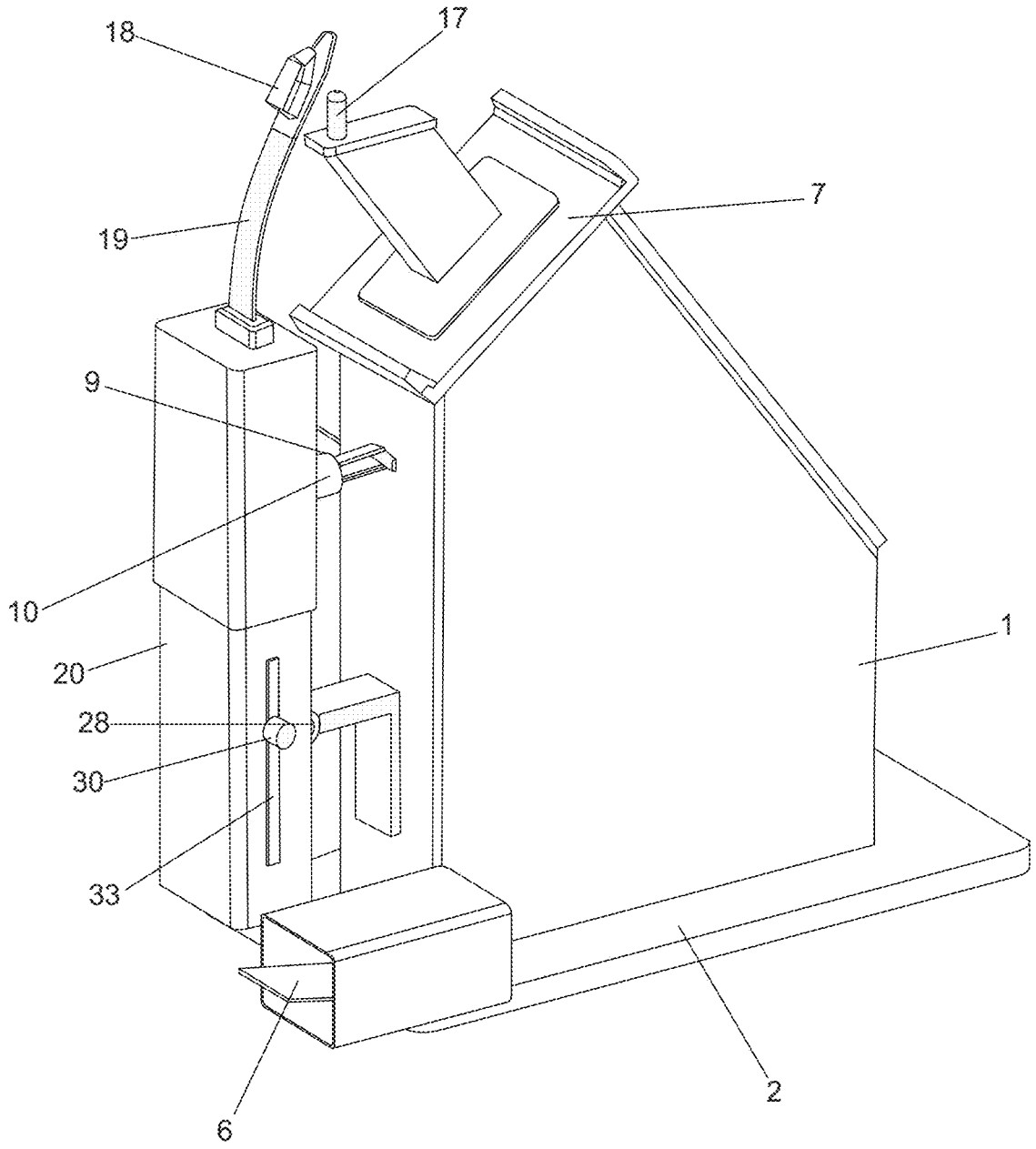
FIG. 2: Perspective overview of the machine according to the invention, highlighting the anchor-brace holding the last and the shoe horn with a gripper clamp for uppers, a shoe horn tractioning device with an adjustable sensor for releasing the clamp, in addition to the proportional action pedal.
Figure 3:
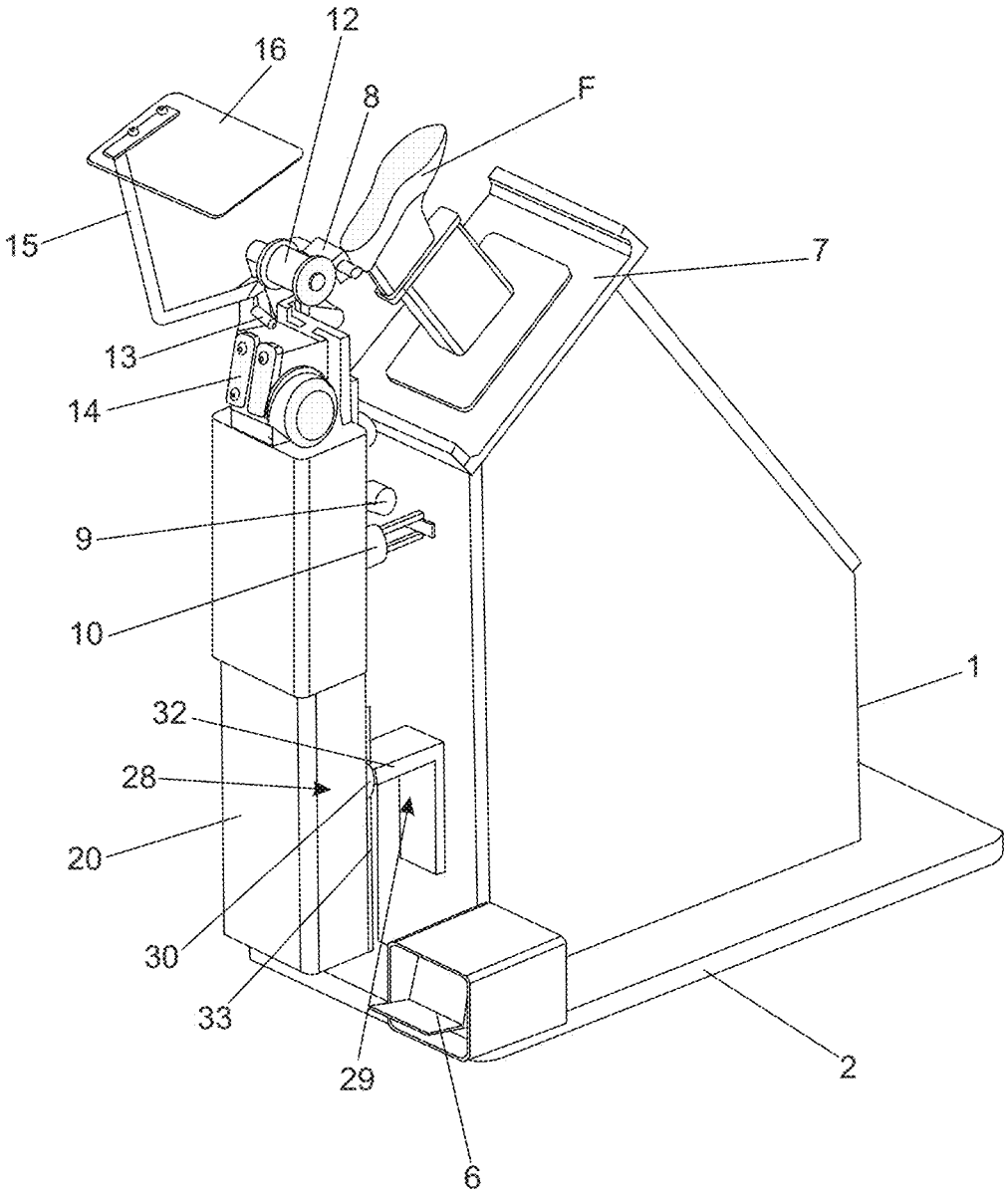
FIG. 3: Perspective overview of the machine according to the invention, highlighting the string-lasting device module and its mechanisms.

Use of the shoe upper assembly machine takes place in the following manner for the module (3) placing shoe uppers on the last (F):

- the height (vertical) and distance (horizontal) adjustments are defined by the operator, depending on the shoe to be fitted, for module (3) as well as module (4);
- the last (F) is attached to the anchor-brace (17) of the module (3) for fitting shoe uppers on to the last and the shoe upper (C1) is positioned on the said anchor-brace (17) (FIG. 2);
- the operator positions the shoe horn clamp (18) on the rear extremity of the shoe upper (C1), which is the location of the heel of the shoe and tightens the clamp, using the first stage of the pedal (6) (FIG. 5*a*);
- by pressing his foot down steadily on the pedal (6), the operator activates the shoe contract that pulls the shoe upper (C1) into position on the last (F). Traction force and speed are proportional to the force or movement of the foot on the pedal (6). It is convenient that this device be connected through the pedal (6), as in this way the hands can help fit the shoe upper (Cl) on to the last (F) (FIG. 5*b*);
- when the foot is lifted from the pedal (6), the clamp (18) opens and goes back to the return position (FIG. 5*c*);
- the operator then commands and moves the brace anchoring the last (F) up to the string-lasting device module (4).

The string-lasting device module (4) has the following operating sequence:

- with the last (F) and the shoe upper (C1) in the correct position, the operator positions the ends of the strings (C2) in the brace (13) and feeds them into the gripper clamp (27). He then presses down again on the same pedal (6), activating the first stage of this function through activating the gripper clamp (27) and moving the heel clamp up against the shoe upper (C1), holding it firmly on the last (F) (FIG. 6*a*);
- the operator then activates the string-lasting device by pressing down steadily on the foot pedal (6) in order to adjust the shoe upper (C1) around the last (F) in the shoe sole region. Traction force and speed are proportional to the pressure on the pedal. Once again, the operator's hands are free to help position the shoe upper (C1) (FIG. 6*b*);
- with the shoe upper (C1) already assembled on the last (F), once the foot is lifted from the pedal (6), the last (F) may be removed from the machine, completing the operation.

According to the invention, the results are achieved through the actions performed by the operator, with the force applied to the pedal (6) in order to control the movements performed by the shoe horn tractioning device and the string-lasting device, reflected proportionally in the force and speed applied to the machine, depending on the variations needed for each shoe model.

In terms of the functionality of the systems constituting the machine, the module for fitting shoe uppers on to the last (F) is activated by the pedal (6), for tightening the shoe horn clamp (18) with pre-set force, as well as for the shoe horn traction, with activation force and speed proportional to the pressure used by the operator.

The string-lasting device module (4) is activated by the pedal (6), in order to activate the string gripper clamp (27) and the heel clamp (12) against the shoe upper (C1), with pre-set force and for string-lasting (C2), with activation force and speed in proportion to the pressure used by the operator.

When the direct action proportional pressure (force) and flow (speed) valve (37) is in the resting position, through progressively activating the pin (Z), the pressure (P) starts to flow towards the outlet (A) with flow and pressure in proportion to the difference in the value applied to the activator (Z). When reaching the desired midpoint between the action (Z) and the result on the job (A) through the movement (X), the status shifts to pressure maintenance (f).

The flow and pressure at (A) are provided in proportion to the difference between the amount of pressure applied and its reaction.

With regard to the electro-pneumatic circuit (FIG. 8), the same function logic may be obtained through opting for elements of alternative technical origin. Consequently, an electronic pedal (6B) may be used with digital or analog data outflows, an electronic signal processing module, and proportional power activation through an electro-pneumatic proportional valve and a pneumatic or electric force activator.

The machine addressed by the invention may be commercialized in a customized way for each application. In other words, it may be composed of a housing that holds any one of the independent modules. All may comprise an association of the housing with two or three modules, or may also be assembled with the housing and three modules together.

As mentioned previously, the machine addressed by this invention is intended for the high-productivity footwear assembly sectors using the string-lasting method-stitching the edges with a lasting string. Its main purposes are:

- footwear assembly automation through the string-lasting method, bringing different functions together at a single work post, in order to reduce indirect time while performing the tasks. This factor contributes significantly to lower operating costs;
- process automation provides replicability and standardization for performing the tasks, upgrading the quality of the finished product;
- commanded by the operator, the actions of the assembly replace manual efforts for fitting the shoe upper onto the last, as well as for tightening the string, endowing these tasks with greater force, speed and precision. This eliminates repetitive stress injuries that are common among skilled workers employed on shoe assembly lines using the string-lasting method performed by hand;

allows the assembly of other types of footwear through the string-lasting method, which was previously restricted to models whose uppers were made from light, flexible materials that were easy to handle. This assembly alternative has become feasible because string-lasting, which was previously performed by hand, requiring strength and skill from operators, can now be undertaken mechanically through the use of a simple mechanism that is fully controlled by the operator through pressure applied to the pedal;

the adoption of an uppers assembly machine allows shoe uppers to be assembled in full by a non-specialized operator through a single string-tightening step, with lower operating costs, particularly compared to the traditional footwear assembly system that uses individual assembly positions for toe-caps, vamps and the back of the shoe. Furthermore, in most cases, adoption of the string-lasting method requires shoe remodeling that helps reduce the consumption of materials used for the uppers, resulting in less waste and resulting in less waste and scraps of left-over material.

What is claimed is:

1. A shoe upper mounting machine with a string-lasting device that uses a string-lasting method for large-scale production, comprising:

a support housing (1), supported on a base (2), a first module (3) for fitting a shoe upper on a last (F), a second device module (4) for string lasting, a third module (5) for assembling and dismantling a mountable shoe last; the modules selectively acting independently or in association with one another: and force and speed activators in the first and second modules (3) and (4).

2. The shoe upper mounting machine with string-lasting device according to claim 1, wherein the first and second modules (3) and (4) are fitted with a pedal (6) with a double start-up command (on/off) and proportional force and speed command.

3. The shoe upper mounting machine with string-lasting device according to claim 1, wherein the last (F) for the shoe uppers (C1) is arrayed on a support (S1) that anchors the last, positioned on an inclined surface (7) on the upper part of the first module (3), with a buffer-stop at the front of the last (F) for holding a heel (8) which has vertical height regulation through pivoting (9) on a support (10) and with horizontal proximity adjustment through displacement of the support (10), in order to move the buffer-stop towards or away from the tractioning device assembly.

4. The shoe upper mounting machine with string-lasting device according to claim 1, wherein, in front of the last (F), a string guide roller (12) is included, which is aligned with a string brace (13), attached to a support (14), from which an arm (15) of a protective transparent cover (16) projects.

5. The shoe upper mounting machine with string-lasting device according to claim 1, wherein the module (3) for fitting shoe uppers on to the last (F) comprises a mechanical pneumatic assembly consisting of the brace anchoring the actual last (17), together with a shoe horn and uppers gripper clamp (18), with a flexible blade (19) mounted in a structure (20), through which the shoe horn tractioning device (21) is laterally visible, with an adjustable clamp release sensor, with the said tractioning device (21) being adjustable through a slot (22) in the structure.

6. The shoe upper mounting machine with string-lasting device according to claim 1, wherein the shoe horn tractioning device (21) contains an adjustable sensor that includes the sensor (23) and the receiver (24), attached to the clamp activation assembly, adjacent the middle (25) where a flexible blade (19) is affixed.

7. The shoe upper mounting machine with string-lasting device according to claim 1, wherein the string-lasting device module (4) is a mechanical pneumatic assembly consisting of the support (S1) that anchors the last (F), the said support (S1) functions in association with the support in contact with the shoe uppers (26) and the string guide roller (12); a string gripper clamp (27), a buffer-stop (8) for holding the heel, with vertical height and horizontal proximity regulation, and a vertical height (28) and horizontal proximity (29) adjustment system.

8. The shoe upper mounting machine with string-lasting device according to claim 1, wherein the vertical height regulation uses a sliding handle or knob (30) on a vertical bar (31), and the horizontal proximity adjustment uses a toothed bar (32) slidable along a slot (33).

9. The shoe upper mounting machine with string-lasting device according to claim 1, wherein the tractioning device assembly consists of a string-lasting force activator (C2), through a pneumatic cylinder (34) activated by the pedal (6), which operates through an articulated arm (35) alongside the string guide roller (12), also operating through a contact support point (36) with the shoe uppers (12B).

10. The shoe upper mounting machine with string-lasting device according to claim 1, further comprising linear movement of the string-lasting force activator.

11. The shoe upper mounting machine with string-lasting device according to claim 1, wherein a direct action proportional pressure (force) and flow (speed) valve (37), works with the string tightening system and the shoe horn for shoe uppers with a clamp.

12. The shoe upper mounting machine with string-lasting device according to claim 11, further comprising a proportional valve (37) with a proportional pressure mechanical activation pin (Z), as well as a pressure inflow point (P) for the system, while the element (A) presents the pneumatic flow outlet with pressure and flow proportional to the activation action of (Z); the element (R) represents the return of the working pressure (A) into the atmosphere, while (X) is action spring for returning to the rest position;

finally, the element (e) indicates the proportional action position, while (f) is the proportional control mid-position and (g) is the proportional return mid position of the action.

13. The shoe upper mounting machine with string-lasting device according to claim 1, further comprising a pneumatic circuit with a sensor and a proportional force and speed activator for command modules (3) and (4).

14. The shoe upper mounting machine with string-lasting device according to claim 13, wherein comprises the automation of the string-lasting device module (4) and the uppers fitting module (3), which includes the proportional pedal (6) connected to a sequence of three-way valves (38), with this assembly functioning with pressure regulators (39), which also allows adjustment control limiting the maximum tensile strength of the strings, while the pneumatic cylinders (40) handle the activation and control of the string gripper clamp assembly (27) (C2); while the uppers bagging module (3) discloses an activation pneumatic cylinder (41) alongside the uppers gripper damp (18), with a set of three-way valves (38) and a second tension pressure return pneumatic cylinder (42).

15. The shoe upper mounting machine with string-lasting device according to claim 1, wherein comprises an electro-pneumatic sensor circuit and a proportional force and speed activator in an alternative way through an electronic pedal (6B), a logic controller (43)—electronic signal processing module-powering the pedal (6B) and that intercommunicate through a proportional pressure transducer (44)—proportional power activation through an electro-pneumatic proportional valve—at the pneumatic circuit outlook point (45).

16. The shoe upper mounting machine with string-lasting device according to claim 1, further comprising, a machine holding a device for boots (11), with height regulation.

17. The shoe upper mounting machine with string-lasting device according to claim 5, wherein the shoe horn tractioning device (21) contains an adjustable sensor that includes a sensor (23) and a receiver (24), attached to the clamp activation assembly, adjacent the middle (25) where a flexible blade is affixed (19).

18. The shoe upper mounting machine with string-lasting device according to claim 7, wherein the vertical height regulation uses a sliding handle or knob (30) on a vertical bar (31), and horizontal proximity adjustment uses a toothed bar (32) that can slide along a slot (33).

19. The shoe upper mounting machine with string-lasting device according to claim 8, wherein the tractioning device assembly consists of a string-lasting force activator (C2), through a pneumatic cylinder (34) activated by the pedal (6), which operates through an articulated arm (35) alongside the string guide roller (12), also operating through a contact support point (36) with the shoe uppers (12B).

20. The shoe upper mounting machine with string-lasting device according to claim 9, further comprising a linear movement of the string-lasting force activator.

* * * * *